US007490932B2

(12) United States Patent
Joppen

(10) Patent No.: US 7,490,932 B2
(45) Date of Patent: Feb. 17, 2009

(54) DEVICE AND METHOD FOR HANDLING INK DROPS

(75) Inventor: Sandor H. G. Joppen, Venlo (NL)

(73) Assignee: Oce-Technologies B.V., Venlo (NL)

( * ) Notice: Subject to any disclaimer, the term of this patent is extended or adjusted under 35 U.S.C. 154(b) by 456 days.

(21) Appl. No.: 10/992,336

(22) Filed: Nov. 19, 2004

(65) Prior Publication Data

US 2005/0134637 A1 Jun. 23, 2005

(30) Foreign Application Priority Data

Dec. 5, 2003 (EP) ..... 03078810

(51) Int. Cl.
*B41J 2/01* (2006.01)

(52) U.S. Cl. ..... 347/103; 347/101

(58) Field of Classification Search ..... 347/22–36, 347/102, 103, 101, 104
See application file for complete search history.

(56) References Cited

U.S. PATENT DOCUMENTS

| | | | | |
|---|---|---|---|---|
| 6,082,848 | A | 7/2000 | Taylor | |
| 6,196,654 | B1 | 3/2001 | Uchida et al. | |
| 6,340,220 | B1 | 1/2002 | Gaylor et al. | |
| 6,386,697 | B1 * | 5/2002 | Yamamoto et al. | 347/103 |

* cited by examiner

*Primary Examiner*—Manish S Shah
(74) *Attorney, Agent, or Firm*—Birch, Stewart, Kolasch & Birch, LLP

(57) ABSTRACT

A device for conveying ink drops from a receiving station, where the ink drops originating from a printhead are received, to a discharge station, where the ink drops in a dried condition are discharged, wherein the device includes a conveyor belt for conveying the ink drops, the conveyor belt having a belt surface for supporting the ink drops during their conveyance from the receiving station to the discharge station, wherein at the discharge station the conveyor belt is provided with means for loosening at least a leading portion of the dried ink drops by changing the path of movement of the belt surface from one plane to another.

28 Claims, 3 Drawing Sheets

DEVICE AND METHOD FOR HANDLING INK DROPS

This non-provisional application claims priority under 35 U.S.C. § 119(a) on Patent Application No. 03078810.3 filed in The European Patent Office on Dec. 5, 2003, which is herein incorporated by reference.

BACKGROUND OF THE INVENTION

The present invention relates to a device and a method for handling ink drops, particularly for receiving ink drops from a printhead or a printhead cleaning unit and discharging the ink drops into an ink drop collection tray.

It is known to collect ink drops falling down from a printhead or a printhead cleaning unit in a collection tray. The ink drops fall in a liquid condition and set or become rigid in the collection tray, thereby possibly forming stalagmites. These stalagmites may cause a problem in that they may interfere with the movement of the printhead or the cleaner. An operator must be available to periodically and timely remove the stalagmites.

It is further known to intercept the ink drops falling down from a printhead or a cleaning unit by using a belt conveyor which, in a forward track, runs from a location of receiving ink drops to a location of discharge or delivery of the ink drops to a collection tray or the like. At the location of discharge, the conveyor belt turns in an opposite direction in a backward track with the solidified ink drops being taken along. At the lower side of the conveyor belt, after the turning area, a stationary scraper is provided to engage the ink drops attached to the conveyor belt and scrape them from the conveyor belt. A disadvantage of this known arrangement is that the scraper, in order to function reliably, must engage the belt surface causing the belt surface to experience considerable wear and tear.

In a further known arrangement the ink drops falling down are received by a conveyor belt that circulates about four rollers arranged in a vertical square: one upper roller, one lower roller and two side rollers. Considered in a cross-section of the belt, the upper roller has a concave belt supporting surface and the lower roller has a convex belt supporting surface. The concave portion of the belt forms a trough for the ink drops. By the outward flexing of the belt, as considered in cross-section, towards the convex shape, the ink drops on the belt are loosened in order to fall on the bottom wall of the refuse chamber in which the arrangement is positioned below an ink drop inlet arranged in the upper wall thereof. Although the intention here is to loosen the ink drops by the conversion of the shape of the ink drop support surface, that is the belt, which might result in a simple structure, some ink drops, nonetheless, remain attached to the conveyor belt.

Therefore, there is a need for a device for receiving ink drops from a printhead or a printhead cleaning unit and discharging the ink drops into an ink drop collection tray with improved reliable performance. In addition, there is a need for a method for receiving ink drops from a printhead or a printhead cleaning unit and discharging the ink drops to an ink drop collection tray with improved, reliable performance.

SUMMARY OF THE INVENTION

From one aspect, the present invention provides a device for conveying ink drops from a receiving station, where the ink drops originating from a printhead are received, to a discharge station, where the ink drops in a dried condition are discharged, wherein the device includes a conveying surface, for example, a conveying driver or a conveyor belt for conveying the ink drops, the conveyor belt having a belt surface for supporting the ink drops during their conveyance from the receiving station to the discharge station, wherein at the discharge station the conveyor belt is provided with means for loosening at least a leading portion of the dried ink drops by changing the path of movement of the belt surface to a vertical plane.

From another aspect, the present invention provides a method for conveying ink drops from a receiving station, where the ink drops originating from a printhead are received, to a discharge station, where the ink drops in a dried condition are discharged, wherein the method includes the steps of receiving the ink drops on a belt conveyor surface, allowing the ink drops to set on the belt surface so as to form dried ink drops at the discharge station, progressively peeling off a leading portion of the set ink drops from the belt surface by changing the path of movement of the belt surface, loosening the ink drops in their entirety from the belt surface and delivering the ink drops to an ink drop collector. In this way, use can be made of the change in direction of the belt that already has to take place for the backward movement of the belt towards the receiving station. The arrangement may consequently be simple and reliable in operation. Advantageously, use can be made of the more or less flat shape and the rigidity of the ink drops, as they are directed in a vertical plane to the path of the conveyor. The change in the configuration of the belt while running past the discharge station automatically results in a peeling off of the solidified ink drops from the belt.

According to a further development of the device according to the present invention, the means for loosening the ink drops includes the steps of progressively diverging the leading portion of the belt surface from the path of movement of the belt surface. The peeling-off effect is improved in the case where the change in direction is sharp. Thus, the means for loosening the ink drops is achieved by changing the path of movement of the belt surface to a convex turning path, in particular a convex turning path with a turning angle of at least 90 degrees.

Advantageously, the radius of the convex turning path is adjusted to the length of the ink drops on the belt surface. By way of example, the radius of the convex turning path may be less than the length of the ink drops on the belt surface. A typical radius used is between 1-6 mm.

In a further development of the device or method according to the present invention, the drying of the ink drops, which are positioned between the receiving station and the discharge station, is accelerated. This can be realized by providing means positioned below the belt surface supporting the ink drops and may comprise a belt supporting cooling plate. The ink drops can be solidified within a short period of time, during which the belt conveyor may be held stationary for a while after receipt of an ink drop, and then shifted to present an adjacent belt surface to the subsequent ink drops that fall down. In this way it is ensured that the ink drops will be solidified to such an extent that they will be rigid in the vertical plane and the peeling off process will be enhanced.

In yet a further embodiment of the device and method of the present invention, additional means for loosening a trailing portion of the dried ink drops from the belt surface are used. Such means for loosening a trailing portion of the dried ink drops from the belt surface includes a stationary stop engaging the loosened leading portion of the ink drops. In this way it is ensured that under all circumstances the ink drops are peeled off completely from the belt surface.

BRIEF DESCRIPTION OF THE DRAWINGS

The present invention will now be described by referring to the accompanying drawings, wherein.

DETAILED DESCRIPTION OF THE INVENTION

Figure 1:
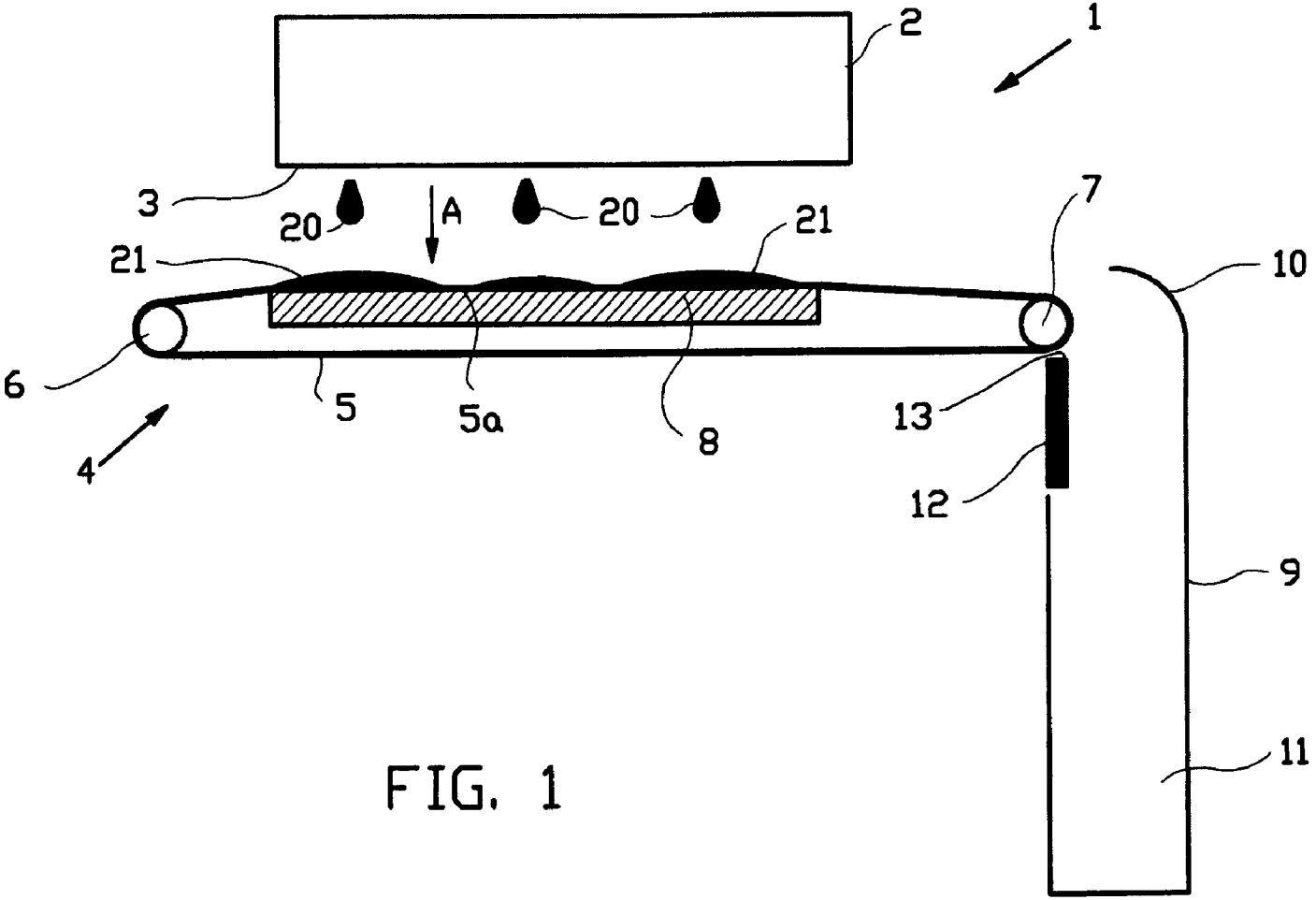
FIG. 1 is a schematic view, in a vertical plane, of a device according to the present invention, in a first stage of use.

FIG. 1 shows a device 1 embodying the present invention, which includes a belt conveyor 4 utilizing an endless belt 5 mounted on drive roller 6 and idle roller 7. The upper track of the belt 5 is positioned below a printhead 2 having a lower surface 3 from which ink can be delivered during printing in a manner known per se. It should be noted that instead of printhead 2 a printhead cleaning unit can be located above the conveyor 4, depending on the structure of the printer arrangement (that is not shown).

The upper track of the belt 5 is supported on a cooling plate 8, which is adapted to cool the surface 5*a* of belt 5.

Adjacent to idle roller 7 an ink drop collection tray 9 is arranged, which tray 9 defines a collecting space 11. At its upper side, the tray 9 has a curved deflector wall portion 10, which extends above the upper belt track, at the location of the roller 7.

Below the roller 7 the tray 9 is provided with a stop or abutment plate 12, the upper end 13 of which is spaced below the roller 7 and the lower track of the belt 5.

Figure 2:
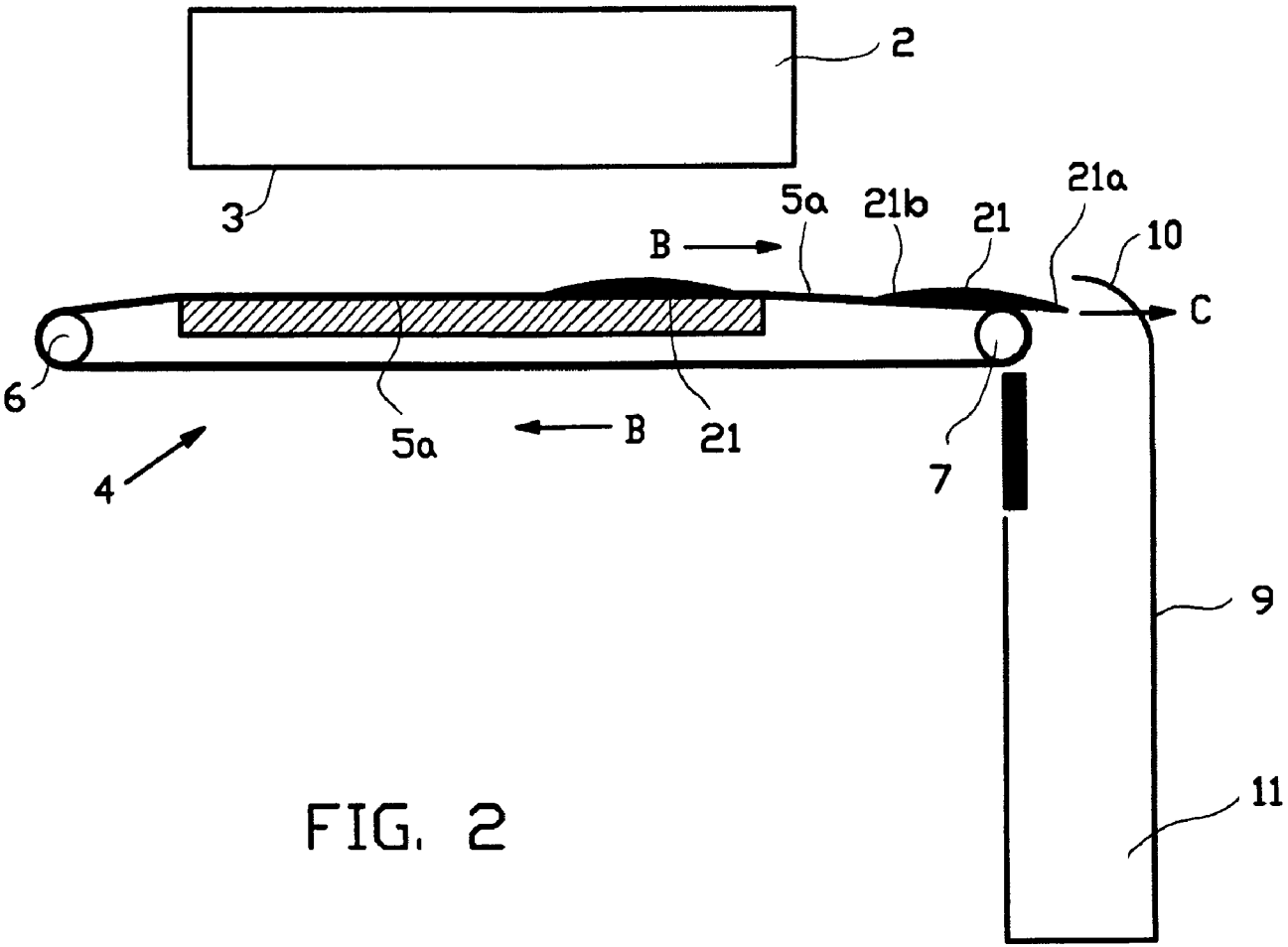
FIG. 2 is a schematic view, in a vertical plane, of the device of FIG. 1, in a second stage of use.
Figure 3:
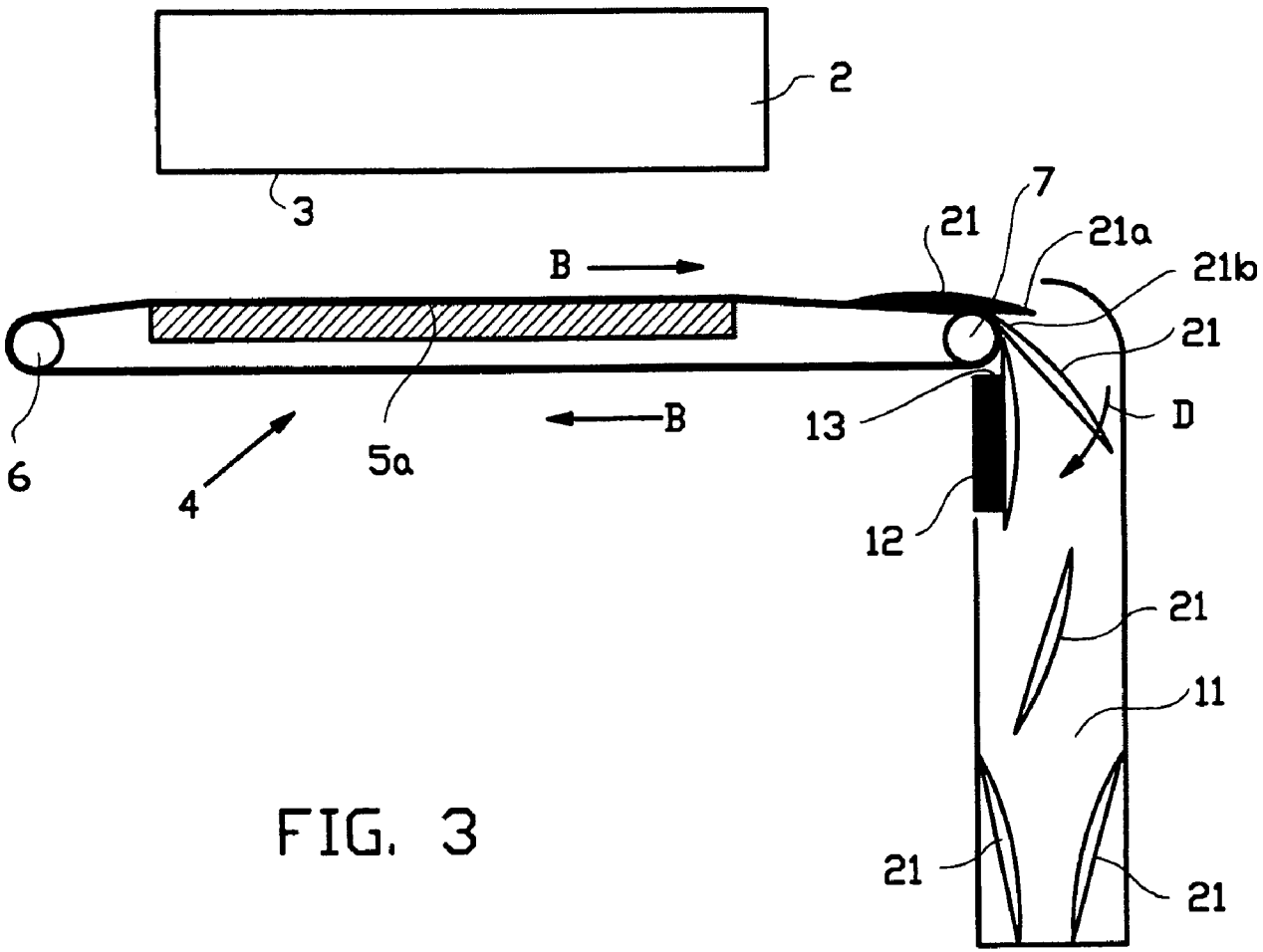
FIG. 3 is a schematic view, in a vertical plane, of the device of FIG. 1, in a third stage of use.

The device 1 of FIGS. 1-3 operates as follows.

In FIG. 1, the situation is depicted in which the upper track of the belt 5, supported by plate 8, receives ink drops 20 falling down in the direction A from the lower surface 3 of the printhead 2. When hitting the upper surface of belt 5, the drops 20 flow out over the belt surface to some extent to form disc-shaped plaques 21. In this example, the drive roller 6 is not activated, so that the plaques 21 are allowed to dry, assisted by the presence of the cooling plate 8.

When the plaques 21 have been solidified to a sufficient extent, the drive roller 6 is activated to drive the upper track of the belt 5 in the direction B. As a result, the plaques 21 are conveyed in the direction B, to arrive at the roller 7. As can be seen in FIG. 2, the plaques 21 exhibit resistance to bending so that their leading portion 21*a* continues its path of movement in direction C, that is to say, the direction of movement of the portion of the belt 5 directly upstream of roller 7. As a consequence, the leading portion 21*a* of the plaque 21 will automatically peel off from the belt surface 5*a*.

Upon continued movement of the belt 5, the plaque 21 will be moved by the deflecting wall 10 to rotate in direction D. In some cases, the plaque 21 will be completely separated from the belt surface during this movement. In other cases, a small trailing portion 21*b* of the ink plaque 21 may remain attached to the belt surface. In this case, the lower surface of the plaque 21 will, as depicted in FIG. 3, hit the abutment plate 12. Due to the continued movement of the belt 5 the trailing portion 21*b* will be urged to release from the belt surface. Then the plaque 21 will fall downwards from the abutment plate 12 into the space 11. An operator may periodically empty the tray 9. The device and process according to the present invention are particularly suitable for use in hot melt ink printing.

What is claimed is:

1. A device for conveying ink drops from a receiving station where the ink drops originating from a printhead are received, to a discharge station, where the ink drops in a dried condition are discharged, which comprises a conveyor belt for conveying the ink drops, the conveyor belt having a belt surface for supporting the ink drops during their conveyance from the receiving station to the discharge station, wherein at the discharge station the conveyor belt is provided with means for loosening at least a leading portion of the dried ink drops and then separating the dried ink drops from the conveyor belt in their entirety by abruptly changing the path of movement of the belt surface from one plane to another plane.

2. The device according to claim 1, wherein said means for loosening the ink drops comprises progressively changing the path of movement of the belt surface containing the ink drops.

3. The device according to claim 2, wherein the path of movement of the belt surface is changed according to a convex turning path.

4. The device according to claim 3, wherein said convex turning path has an angle of at least 90 degrees.

5. The device according to claim 3, wherein the radius of curvature of the convex tuning path is adjusted to the length of a plaque formed by a number of ink drops on the belt surface.

6. The device according to claim 3, wherein the radius of curvature of the convex tuning path is smaller than the length of a plaque formed by a number of ink drops on the belt surface.

7. The device according to claim 1, further comprising means for accelerating the drying of the ink drops positioned between the receiving station and the discharge station.

8. The device according to claim 7, wherein said means for accelerating the drying of the ink drops is positioned below the belt surface supporting the ink drops.

9. The device according to claim 8, wherein the means for accelerating the drying of the ink drops is a belt-supporting cooling plate.

10. The device according to claim 1, further comprising means for loosening a trailing portion of the dried ink drops from the belt surface.

11. The device according to claim 10, wherein the means for loosening a trailing portion of the dried ink drops from the belt surface comprises an abutment plate for engaging the loosened leading portion of the ink drops.

12. A method for conveying ink drops from a receiving station, where the ink drops originating from a printhead are received, to a discharge station, where the ink drops in a dried condition are discharged, which comprises the steps of receiving the ink drops on a belt conveyor surface, allowing the ink drops to set on the belt surface so as to form dried ink drops at the discharge station, progressively separating a leading portion of the dried ink drops from the belt surface at said discharge station by abruptly changing the path of movement of the belt surface from one plane to another plane, and separating the dried ink drops in their entirety from the belt surface, and delivering the ink drops to an ink drop collector.

13. The method according to claim 12 wherein the step of peeling off the leading portion is carried out by changing the path of movement of the belt surface according to a convex turning path.

14. The method according to claim 13, wherein the belt surface is turned about an angle of at least 90 degrees.

15. The method according to claim 14, further comprising the step of adjusting the radius of the convex turning path to the length of the ink drops in the belt surface.

16. The method according to claim 15, wherein the radius of the convex turning path is smaller than the length of the ink drops on the belt surface.

17. The method according to claim 12, further comprising the step of accelerating the drying of the ink drops during their travel from the receiving station to the discharge station.

18. The method according to claim 17, wherein accelerating the drying of the ink drops is carried out by cooling the ink drops with a plate positioned below the belt surface supporting the ink drops and supporting the belt.

19. The method according to claim 12, further comprising the step of loosening a trailing portion of the dried ink drops from the belt surface after the leading portion has been peeled off from the belt surface by engaging the leading portion of the ink drops with a stationary stop.

20. The method according to claim 12, wherein the loosened ink drops are collected in a container by falling from the discharge station.

21. The device of claim 11, wherein the abutment plate is positioned to engage a lower surface of the dried ink drops where the path of movement of the belt surface first changes from one plane to another plane.

22. The device of claim 1, wherein a deflecting wall is positioned at the discharge station where the path of movement of the belt surface is changed from one plane to another, to facilitate the separation of the dried ink drops from the conveyor belt.

23. The device of claim 22, wherein an abutment plate is positioned to engage a lower surface of the dried ink drops where the path of movement of the belt surface first changes from one plane to another plane.

24. A device for conveying ink drops from a receiving station where the ink drops originating from a printhead are received, to a discharge station, where the ink drops, in a dried condition, are discharged, which comprises a conveyor belt for conveying the ink drops, the conveyor belt having a belt surface for supporting the ink drops during their conveyance from the receiving station to the discharge station, wherein at the discharge station the conveyor belt is provided with means for loosening at least a leading portion of the dried ink drops by abruptly changing the path of movement of the belt surface from one plane to another plane sufficient to cause complete separation of ink drops from the belt surface.

25. A device for conveying ink drops from a receiving station where the ink drops originating from a printhead are received, to a discharge station, where the ink drops in a dried condition are discharged, which comprises a conveyor belt for conveying the ink drops, the conveyor belt having a belt surface for supporting the ink drops during their conveyance from the receiving station to the discharge station, wherein at the discharge station the conveyor belt is provided with means for loosening at least a leading portion of the dried ink drops by progressively changing the path of movement of the belt surface containing the ink drops from one plane to another plane according to a convex turning path, wherein the radius of curvature of the convex turning path is adjusted to the length of a plaque formed by a number of ink drops on the belt surface.

26. A device for conveying ink drops from a receiving station where the ink drops originating from a printhead are received, to a discharge station, where the ink drops in a dried condition are discharged, which comprises a conveyor belt for conveying the ink drops, the conveyor belt having a belt surface for supporting the ink drops during their conveyance from the receiving station to the discharge station, wherein at the discharge station the conveyor belt is provided with means for loosening at least a leading portion of the dried ink drops by progressively changing the path of movement of the belt surface containing the ink drops from one plane to another plane, according to a convex turning path, wherein the radius of curvature of the convex turning path is smaller than the length of a plaque formed by a number of ink drops on the belt surface.

27. A method for conveying ink drops from a receiving station, where the ink drops originating from a printhead are received, to a discharge station, where the ink drops in a dried condition are discharged, which comprises the steps of receiving the ink drops on a belt conveyor surface, allowing the ink drops to set on the belt surface so as to form dried ink drops at the discharge station, progressively separating a leading portion of the dried ink drops from the belt surface at said discharge station by changing the path of movement of the belt surface according to a convex turning path, and adjusting the radius of the convex turning path to the length of the ink drops on the belt surface; wherein the belt surface is turned about an angle of at least 90 degrees.

28. The method according to claim 27, wherein the radius of the convex turning path is smaller than the length of the ink drops on the belt surface.

* * * * *